US011831131B2

(12) United States Patent
Ahlstrand

(10) Patent No.: US 11,831,131 B2
(45) Date of Patent: Nov. 28, 2023

(54) IONIZING ARRANGEMENT

(71) Applicant: CabinAir Sweden AB, Stockholm (SE)

(72) Inventor: Thomas Ahlstrand, Stockholm (SE)

(73) Assignee: CabinAir Sweden AB, Stockholm (SE)

( * ) Notice: Subject to any disclaimer, the term of this patent is extended or adjusted under 35 U.S.C. 154(b) by 645 days.

(21) Appl. No.: 17/040,339

(22) PCT Filed: Mar. 22, 2019

(86) PCT No.: PCT/SE2019/050258
§ 371 (c)(1),
(2) Date: Sep. 22, 2020

(87) PCT Pub. No.: WO2019/182504
PCT Pub. Date: Sep. 26, 2019

(65) Prior Publication Data

US 2021/0021107 A1 Jan. 21, 2021

(30) Foreign Application Priority Data

Mar. 22, 2018 (SE) ..... 1850324-3

(51) Int. Cl.
*H01T 19/04* (2006.01)
*F24F 8/192* (2021.01)
(Continued)

(52) U.S. Cl.
CPC ..... *H01T 19/04* (2013.01); *B03C 3/38* (2013.01); *B03C 3/41* (2013.01); *F24F 8/192* (2021.01); *H01T 23/00* (2013.01); *F24F 8/30* (2021.01)

(58) Field of Classification Search
CPC .... B03C 3/38; B03C 3/40; B03C 3/41; B03C 3/86; F24F 8/192; F24F 8/30; H01T 19/04; H01T 23/00
See application file for complete search history.

(56) References Cited

U.S. PATENT DOCUMENTS 5,147,423 A * 9/1992 Richards ..... H01T 23/00 96/88
2011/0296996 A1* 12/2011 Gao ..... B01J 19/088 96/97

FOREIGN PATENT DOCUMENTS

JP 2011104558 A * 6/2011
WO WO-2011057486 A1 * 5/2011 ..... B01J 19/088
WO WO-2013165242 A1 11/2013

OTHER PUBLICATIONS

Machine Translation of JP-2011104558-A (Year: 2011).*
International Search Report and Written Opinion received for PCT/SE2019/050258, dated Jun. 12, 2019.

* cited by examiner

*Primary Examiner* — Raymond R Chai
(74) *Attorney, Agent, or Firm* — MARSHALL, GERSTEIN & BORUN LLP

(57) ABSTRACT

An ionizing arrangement for electrically charging particles in an air flow in an air duct, said air duct including a section B extending along an axis A. The arrangement includes: a shielding electrode intended to be arranged within the air duct, said shielding electrode including: a portion for arrangement in a plane substantially transverse to the longitudinal axis A, said member has a shape corresponding to the cross sectional shape of the duct. The arrangement furthermore includes at least one corona electrode arranged in the center of the portion, wherein the shielding electrode is further arranged to provide shielding of an electromagnetic field emanating from the corona electrode.

19 Claims, 3 Drawing Sheets

(51) Int. Cl.

| | |
|---|---|
| ***B03C 3/38*** | (2006.01) |
| ***B03C 3/41*** | (2006.01) |
| ***H01T 23/00*** | (2006.01) |
| ***F24F 8/30*** | (2021.01) |

IONIZING ARRANGEMENT

FIELD OF THE INVENTION

The present invention relates to an ionizing arrangement intended to electrically charge particles in an air flow in an air duct.

BACKGROUND OF THE INVENTION

Within many different technical fields, like for example different types of vehicles or buildings air filtration systems are used to ensure the desired air quality within the cabin or building.

Ionizing filtering systems are frequently used since they provide efficient cleaning of air born particles. The ionizing filtering system comprises an ionizer that is configured to electrically charge particles in the air such that the particles adhere to a filter medium arranged downstream the air flow path. The filter medium is preferably charged with the opposite polarity.

Ions can be produced in several ways but one frequently used arrangement comprises an emitter electrode and a collector electrode, for example a corona tip surrounded by a ground electrode, such that particles passing between the emitter electrode and the collector electrode, i.e. the corona tip and the electrode, are charged when a high voltage is applied over the emitter electrode and the collector electrode.

In order to provide an efficient ionization, a high voltage is preferably applied. Unfortunately, the high voltage generates severe electromagnetic field emissions from the arrangement which could eventually be transferred to surrounding equipment and/or systems and affect the function of these systems or equipment.

This drawback is particularly problematic in vehicles where the space for different systems and components is limited, and there is consequently a need for an ionizing arrangement that reduces the amount of electromagnetic emissions from the arrangement.

SUMMARY OF THE INVENTION

The present invention, defined in the appended claims, relates to an ionizing arrangement intended to electrically charge particles in an air flow in an air duct, said air duct comprising a section extending along an axis A, that to at least some extent reduces the problems described above.

An ionizing arrangement according to one aspect comprises a shielding electrode intended to be arranged within the air duct, said shielding electrode having a portion for arrangement in a plane substantially transverse to the longitudinal axis A, said portion having a shape corresponding to the cross sectional shape of the duct. The ionizing arrangement further comprises at least one corona electrode arranged in the centre of the portion. The shielding electrode is further arranged to provide shielding of an electromagnetic field emanating from the corona electrode.

An idea with ionizing arrangement of the present disclosure is to provide an efficient ionizing arrangement and reduce the amount of electromagnetic emissions radiated from the ionizing arrangement to surrounding areas and equipment. The electromagnetic field is reduced outside the shielding electrode as seen from the corona electrode. The reduction of electromagnetic emissions is achieved by the shielding electrode.

The shielding electrode will generally also be arranged to function as a receiver electrode (or collector electrode). This will reduce the number of components which in turn for example enables reduced impact on the air flow through the arrangement.

Furthermore, the shape of the shielding electrode should preferably be such that an impact on the air flow through the arrangement is limited.

In embodiments of the ionizing arrangement, the shielding electrode is arranged to limit electromagnetic emissions in a direction from the corona electrode in which limiting of electromagnetic emissions is desired.

In embodiments of the ionizing arrangement, the shielding electrode is arranged as a Faraday cage.

In further embodiments of the ionizing arrangement the shielding electrode comprises a shielding part extending from the upstream side of said portion and/or a shielding part extending from the downstream side of said portion. The shielding part may for example be a net, such as a net of a conductive material.

By including a shielding part either from the upstream side or from the downstream side only, limitation of electromagnetic field outside the shielding electrode as seen from the corona electrode can be limited on a side for which shielding is desired whereas the other side can be left without any shielding part. By leaving out the shielding electrode on one side the impact on the air flow through the arrangement can be limited.

In embodiments of the ionizing arrangement said portion is a member for arrangement in a plane substantially transverse to the longitudinal axis A, said member having a shape corresponding to the cross sectional shape of the duct. The shielding electrode further comprises at least three arc shaped elements (15; 25) extending from the upstream side of the member; and/or at least three arc shaped elements (16; 26; 36) extending from the downstream side of the member.

In further embodiments of the ionizing arrangement the at least three arc shaped elements have a substantially elongated cross sectional shape in the radial direction from the corona electrode.

In further embodiments of the ionizing arrangement the at least three arc shaped elements have a substantially circular cross sectional shape in the radial direction from the corona electrode.

In further embodiments the ionizing arrangement comprises: a shielding electrode intended to be arranged within the air duct, said shielding electrode comprising: a member arranged in a plane substantially transverse to the longitudinal axis A, said member has shape corresponding to the cross sectional shape of the duct; at least four arc shaped elements extending from the upstream side of the member; and at least four arc shaped elements extending from the downstream side of the member; and at least one corona electrode arranged in the centre of the member, wherein the arc shaped elements have a substantially elongated cross sectional shape in the radial direction from the corona electrode.

An idea with this embodiment is to provide an efficient ionizing arrangement and reduce the amount of electromagnetic emissions radiated from the ionizing arrangement to surrounding areas and equipment. The reduction of electromagnetic emissions is achieved by the enclosing shielding electrode with the characteristic shape of the at least four arc shaped elements extending in the upstream and downstream direction from the member. Furthermore, the claimed shape of the shielding electrode will have a limited impact on the air flow through the arrangement.

In one embodiment of the arrangement, the member has an annular shape, circular shape, oval shape or is shaped as a rectangle with semi-circular ends. The embodiment is favourable since a shielding electrode with these shapes will fit in the most common ducts used to provide an efficient flow of air through the ionizing arrangement.

In one embodiment of the arrangement, the corona electrode is one single corona tip arranged in the centre of the circular member. In this embodiment, the shielding electrode will have the shape of a sphere which is favourable since the distance from the corona tip in the centre to the different arc shaped elements will be substantially constant in all directions thereby ensuring an efficient ionization of particles in the air flow and maintain the electromagnetic waves within the ground element.

One embodiment of the arrangement, the corona electrode is a wire comprising a number of corona tips arranged along the wire, said wire is extending in the plane of the member with the oval shape or the rectangular shape with semi-circular ends such that the corona tips are arranged across the space within the member. This embodiment is favourable in combination with a duct with a corresponding shape as the member since the cross sectional area through the arrangement is maximized. The corona wire comprising a number of corona tips at different locations within the shielding electrode ensures an efficient ionization of the particles in the air flow.

In one embodiment of the arrangement, the at least four arc shaped members on the upstream side of the extend from the member to an assembly point where the at least four arc shaped elements coincide to provide an efficient enclosure of the corona electrode.

In one embodiment of the arrangement, the at least four arc shaped elements extending from the member are arranged at substantially the same distance from each other along the upstream and downstream side of the member. This embodiment ensures an efficient enclosure of the at least corona electrode to prevent the electromagnetic emissions from spreading outside the shielding electrode.

In one embodiment of the arrangement, the arc shaped elements are curved such that the shielding electrode will have a substantially spherical shape to provide an efficient enclosure of the corona electrode, i.e. the corona tip.

In one embodiment of the arrangement, the arc shaped elements are curved such that the shielding electrode will have a substantially elliptical shape, or a cylindrical shape with half spherical ends to provide an efficient enclosure of the corona electrode, i.e. the wire with the corona tips. This embodiment of the shielding electrode is favourable in combination with a duct with cross-sectional shape of an oval, or a cylinder with half spherical ends, which duct shape is frequently used to ensure a large cross sectional area where the space for the duct is limited.

In one embodiment of the arrangement, the arc shaped elements have a substantially elongated cross sectional shape in the radial direction from the corona electrode. This embodiment is very favourable since the cross sectional shape with extended length in radial direction provides an excellent enclosure of the electromagnetic waved generated during the ionization. The elongated cross-sectional shape provides a very efficient enclosure of the electromagnetic waves and reduces the amount of electromagnetic waves emitted further. Different cross sectional shapes are possible, like for example rectangular or oval, but the extension in radial direction is preferably at least twice the width, i.e. the extension is at least 2:1 to the width transverse to the radial direction.

In one embodiment of the arrangement, the shielding electrode furthermore comprises intermediate elements arranged between the arc shaped elements on both sides of the member, said intermediate elements are arc shaped with the same radius as the arc shaped elements, said intermediate elements are shorter than the arc shaped elements and does not extend all the way from the member to the assembly point. The intermediate elements provide additional enclosure of the at least one corona tip of the ionizing arrangement.

In one embodiment of the arrangement, said intermediate elements have substantially the same radius as the adjacent arc shaped elements such that the intermediate elements together with the arc shaped elements will form the spherical, elliptical or cylindrical shielding electrode with rounded ends and enclose the corona electrode surrounded by the shielding electrode.

In one embodiment of the arrangement, the arc shaped intermediate elements have a substantially elongated cross sectional shape in the radial direction from the corona electrode. This embodiment is favourable since the cross sectional shape with extended length in radial direction provides an excellent enclosure of the electromagnetic waved generated during the ionization. The elongated cross-sectional shape provides a very efficient enclosure of the electromagnetic waves and reduces the electromagnetic waves emitted further. Different cross sectional shapes are possible, like for example rectangular or oval, but the extension in radial direction is preferably at least twice the width, i.e. the extension is at least 2:1 to the width transverse to the radial direction.

In one embodiment of the arrangement, the shielding electrode is made of a conductive material such as a conductive plastic material or a metal. These materials make it possible to manufacture the shielding electrode in an efficient way by for example injection moulding or casting.

In one embodiment of the arrangement, the member comprises an upstream part and a downstream part, and the arc shaped elements extending in the upstream direction extend from the upstream part of the member and the four arc shaped elements extending in the downstream direction from the member extend from the downstream part of the member. This embodiment of the shielding electrode is favourable since the shielding electrode could be manufactured in two pieces that after assembly forms the final shielding electrode.

In one embodiment of the arrangement, the corona electrode is connected to a positive voltage and the shielding electrode to a negative voltage or ground, or wherein the corona electrode is connected to a negative voltage and the shielding electrode to a positive voltage or ground.

The different embodiments described above could of course be combined and modified in different ways without departing from the scope of the invention as defined by the appended claims. The foregoing will further be apparent from the following more particular description of example embodiments, as illustrated in the accompanying drawings in which like reference characters refer to the same parts throughout the different views. The drawings are not necessarily to scale.

BRIEF DESCRIPTION OF THE DRAWINGS

Different embodiments of the ionizing arrangement according to the invention are illustrated in the appended figures.

DETAILED DESCRIPTION

Figure 1:
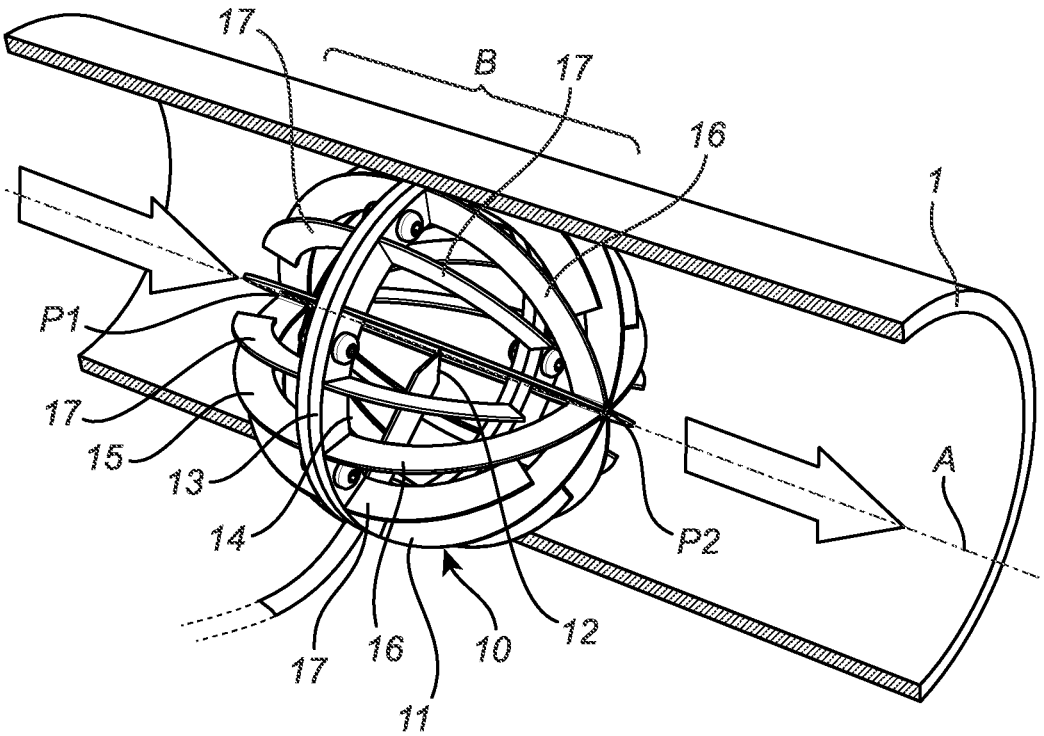
FIG. 1 illustrates schematically a perspective view of a first embodiment of an ionizing arrangement arranged in a duct.

Aspects of the present disclosure will be described more fully hereinafter with reference to the accompanying drawings. The arrangement disclosed herein can, however, be realized in many different forms and should not be construed as being limited to the aspects set forth herein. Like numbers in the drawings refer to like elements throughout.

The terminology used herein is for the purpose of describing particular aspects of the disclosure only, and is not intended to limit the invention. As used herein, the singular forms "a", "an" and "the" are intended to include the plural forms as well, unless the context clearly indicates otherwise.

In FIG. 1 an ionizing arrangement 10 according to the invention is illustrated. The arrangement is intended to be arranged in a duct 1. The duct could for example be arranged to direct a flow of air, indicated by arrows, from the outside of a vehicle to a cabin of the vehicle. The ionizing arrangement according to the invention could however be used in a number of different applications.

Figure 2:
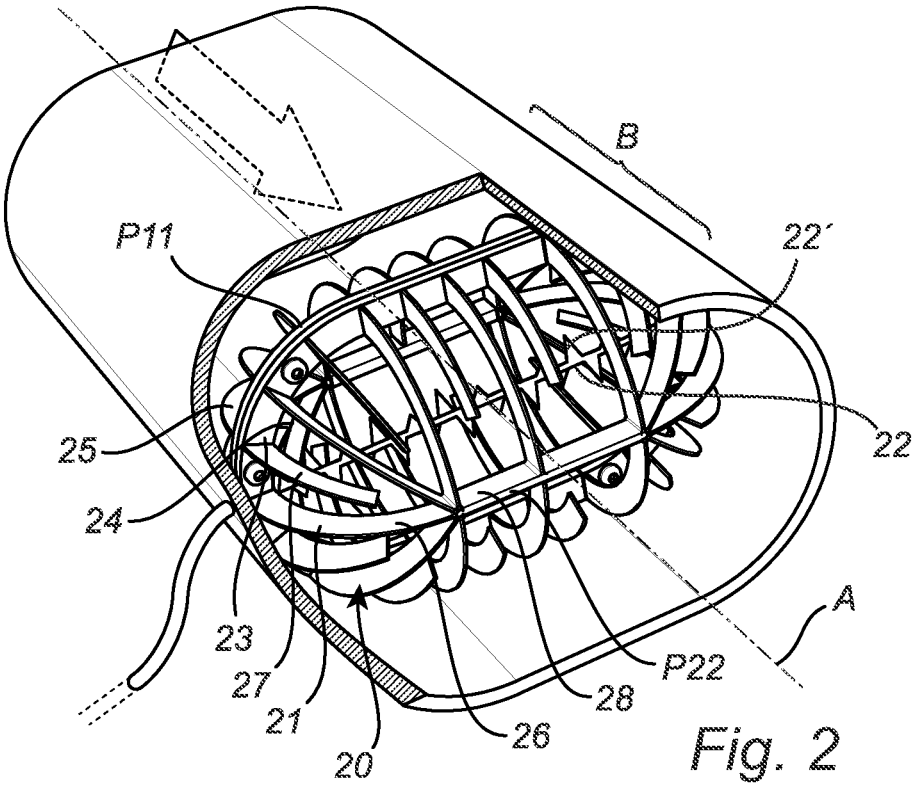
FIG. 2 illustrates schematically a perspective view of a second embodiment of an ionizing arrangement arranged in a duct.

The duct could be designed in different ways with a substantially circular, oval or substantially rectangular cross-sectional shape. Different embodiments of the duct are illustrated in FIGS. 1 and 2. The different cross-sectional shapes could be used to fit within the space available within for example a vehicle.

The duct has at least a section B that is substantially straight and extending along an axis A. The section B could be rather short but should at least exceed the length of the ionizing arrangement along axis A. The ionizing arrangement 10 is intended to be arranged in the substantially straight section B and secured in the intended position within the duct.

The ionizing arrangement 10 is intended to electrically charge air born particles in the air flow through the duct such that the particles could be more efficiently collected in a filter arranged downstream the ionizing arrangement. The filter is not illustrated in the figures but there are a number of different well known filter types suitable for this purpose. Filters used could be pre-charged with a polarity opposite to the polarity of the charged particles in the air to further increase the number of particles collected in the filter, or for example made of a suitable polypropylene material frequently used in to collect particles charged by an ionizing arrangement.

Furthermore, a fan could be arranged somewhere along the duct to generate the desired air flow through the duct, and to make it possible to control the flow of air through the duct and the ionizing arrangement. The fan could be arranged upstream or downstream the ionizing arrangement. The operation of the fan and the ionizing arrangement is controlled by a control unit, not illustrated in the figures.

The ionizing arrangement 10 according to the invention comprises a shielding electrode 11 and an corona electrode 12.

Figure 4:
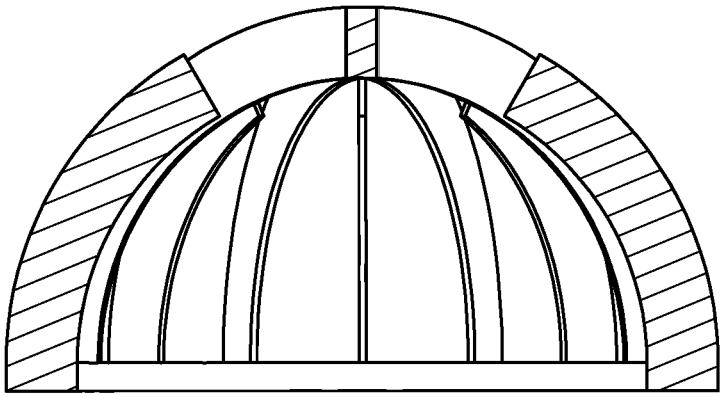
FIG. 4 illustrates a side view of a section of the shielding electrode in FIGS. 1 and 3.
Figure 5:
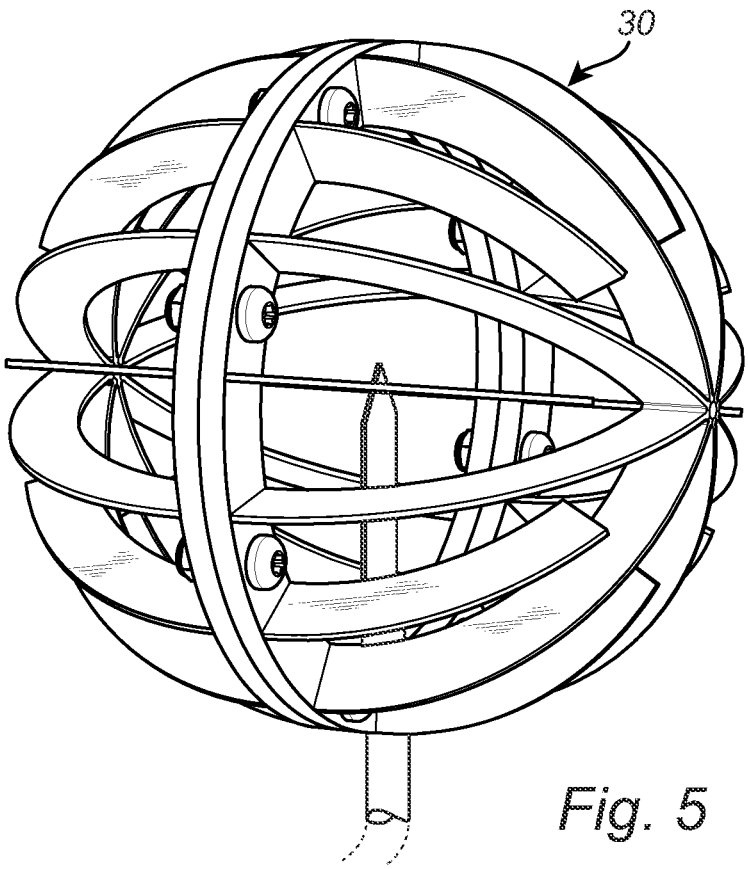
FIG. 5 illustrates schematically a perspective view of the shielding and corona electrode of the first embodiment of the arrangement.

The shielding electrode, illustrated more in detail in FIGS. 4 and 5, is intended to be arranged within the air duct and comprises an annular member 13 arranged in a plane substantially transverse to the longitudinal axis A. The member has an outside shape corresponding to the cross sectional shape of the duct to provide a substantially air tight fitting to the inner periphery of the duct such that no air is allowed to pass between the member and the inner periphery of the duct. The centre of the member is open such that a passage 14 for the air is formed through the member. The dimensions of the member are preferably selected such that the area of the passage transverse to axis A is as large as possible to minimize the impact from the member on the air flow. The member has a substantially constant width transverse to axis A.

In FIG. 1 a first embodiment of the arrangement 10 is illustrated. This embodiment is intended for use in combination with a duct with substantially circular cross-section and consequently the member 13 has a substantially circular shape. The shielding electrode 11 furthermore comprises eight arc shaped elements 15 extending from the upstream side of the member 13 to an assembly point P where the eight arc shaped elements coincide. The arc shaped elements could be permanently secured to each other in the assembly point P, or arranged adjacent to each other. The arc shaped elements have substantially the same radius as the member, and an elongated cross sectional shape in the radial direction from the centre of the member. The cross sectional shape of the arc shaped elements is either rectangular or oval and the arc shaped elements arranged such that the arc shaped element is extending in radial direction from the centre of the member.

The shielding electrode furthermore comprises eight arc shaped elements 16 extending from the downstream side of the annular or oval member to an assembly point P2 such that the shielding electrode will have the shape of a sphere. The arc shaped elements could be permanently secured to each other in the assembly point P2, or arranged adjacent to each other. The cross sectional shape of the arc shaped elements is either rectangular or oval and the arc shaped elements arranged such that the arc shaped element is extending in radial direction from the centre of the member.

The shielding electrode illustrated in FIG. 1 furthermore comprises intermediate elements 17 arranged between the arc shaped elements on both sides of the annular member. The intermediate elements are arc shaped with the same radius as the arc shaped elements but the intermediate elements are shorter than the arc shaped elements and does not extend all the way from the member to the assembly point P1, P2. The reduced length of the intermediate elements reduces the impact on the air flow since the open area through the shielding electrode is increased. The intermediate elements reduce the distance between adjacent arc shaped elements and improves the characteristics of the shielding electrode. The intermediated elements have substantially identical cross sectional shape as the arc shaped elements and is either rectangular or oval, and are arranged such that the intermediate elements extend in radial direction from the centre of the member.

The member 13 is formed by an upstream part 13*a* and a downstream part 13*b* such that the shielding electrode could be divided into two substantially half spherical elements in order to facilitate the manufacturing and assembly of the shielding electrode in the duct.

The corona electrode 12 is arranged to extend from the annular member, i.e. between the upstream and downstream part, towards the centre of the substantially spherical shielding electrode and comprises a corona tip arranged in the centre of the member. The corona tip is connected to a power supply, not illustrated, such that a high voltage cold be supplied to the corona tip to generate the desired electrical fields between the corona tip and the surrounding shielding electrode. The applied voltage is controlled by the not illustrated control unit.

In FIG. 2 a second embodiment of the ionizing arrangement 20 is illustrated. In this embodiment, the member 23 of the shielding electrode 21 has the shape of a rectangle with semi-circular ends to fit in a duct 1*b* with corresponding cross-sectional shape. The member 23 is arranged transverse to the longitudinal axis A and the centre of the member is open such that a passage 24 for the air is formed through the member. In this embodiment, twelve arc shaped elements 25 extend from the upstream side of the member 23 to an elongated assembly point P11 where the eight arc shaped elements coincide, and a similar configuration of arc shaped elements are arranged on the downstream side of the member where twelve arc shaped elements extend to an elongated assembly point P22 such that an enclosed space is formed within the shielding electrode.

The arc shaped elements have substantially the same radius as the semi-circular endings of the member, i.e. the radius is substantially equal to half the distance between the two elongated parallel sides of the rectangular section of the member such that the shielding electrode will have the shape of an elongated cylinder with half spherical ends. An elongated assembly point member 28 is forming the elongated assembly point P21, P22 where the arc shaped elements coincide. The cross sectional shape of the arc shaped elements is either rectangular or oval and the arc shaped elements arranged such that the arc shaped element is extending in radial direction from the centre of the member.

The shielding electrode 21 illustrated in FIG. 2 furthermore comprises the same type of intermediate elements 27 that have been described above in relation to the first embodiment of the arrangement. The intermediate elements are arranged between the arc shaped elements on both sides of the member. The intermediate elements are arc shaped with the same radius as the arc shaped elements but the intermediate elements are shorter than the arc shaped elements and does not extend all the way from the member to the elongated assembly point member 28. The intermediated elements have substantially identical cross sectional shape as the arc shaped elements and is either rectangular or oval.

The corona electrode 22 is in this embodiment formed by a wire extending in the centre of the member from one of the half cylindrical ends to the other. Along the wire, a number of corona tips 22' extending in substantially radial direction from the arranged to extend from the annular member, i.e. between the upstream and downstream part, towards the centre of the substantially spherical shielding electrode and comprises a corona tip arranged in the centre of the member. The corona tip is connected to a power supply, not illustrated, such that a high voltage cold be supplied to the corona tip to generate the desired electrical fields between the corona tip and the surrounding shielding electrode. The applied voltage is controlled by the not illustrated control unit.

Figure 3:
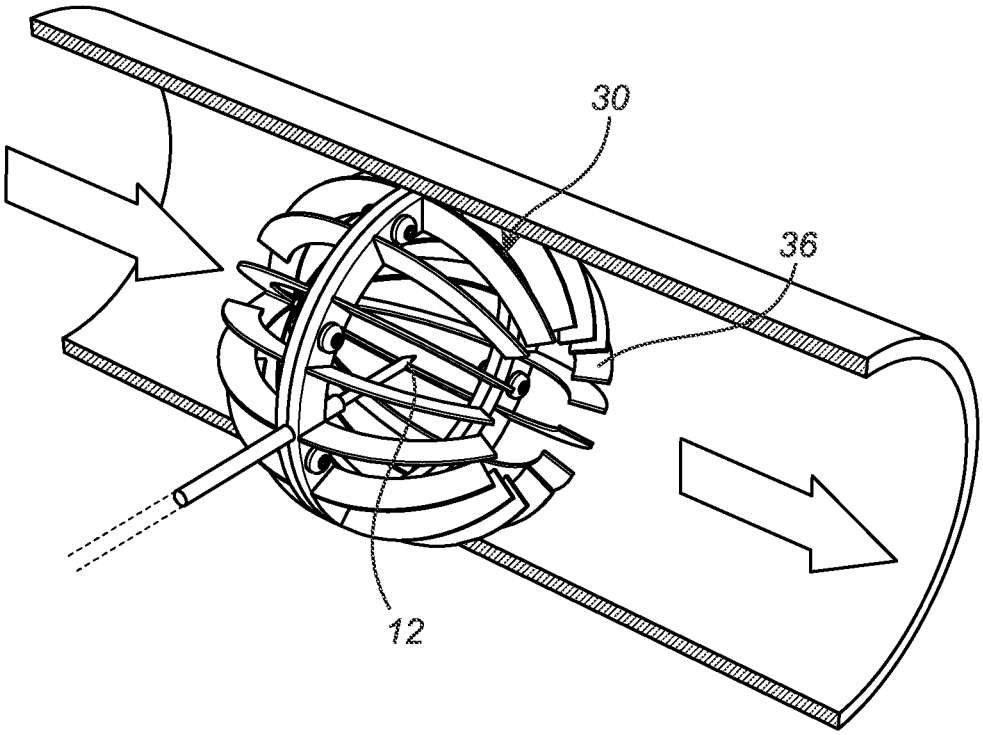
FIG. 3 illustrates schematically a perspective view of a third embodiment of an arrangement according to the invention.

A third embodiment of the arrangement 30 is illustrated in FIG. 3. This embodiment of the arrangement is almost identical as the first one but the arc shaped elements on the downstream side of the circular member does not extend all the way to the assembly point P2. This embodiment is favorable since debris that occasionally reaches the arrangement via the duct will more easily be transferred from the arrangement since a larger opening is formed in the shielding electrode.

Furthermore, the embodiments described above could all be combined and modified in different ways without departing from the scope of the invention that is defined by the appended claims. For example, multiple arrangements could be arranged together, side by side on a carrier or within a duct such that the air flow pass through this carrier or duct.

As indicated above, an idea with ionizing arrangement of the present disclosure is to provide an efficient ionizing arrangement and reduce the amount of electromagnetic emissions radiated from the ionizing arrangement to surrounding areas and equipment. The electromagnetic field is reduced outside the shielding electrode as seen from the corona electrode. The reduction of electromagnetic emissions is achieved by the shielding electrode. Hence, embodiments are not limited to the specific shape and arrangement of the shielding electrode as disclosed in the FIGS. 1-5.

Although the ionizing arrangements described in relation to FIGS. 1-5, have shielding electrodes including a member (13; 23) arranged in a plane substantially transverse to the longitudinal axis, where said member has a shape corresponding to the cross sectional shape of the duct, embodiments are encompassed without such a specific member (13; 23) or where the member (13; 23) is not a specific part but a portion of the ionizing arrangement. In such embodiments a certain portion of the shielding electrode may be arranged to have a shape corresponding to the cross sectional shape of the duct. An aim with such a portion is to provide a suitable fit of the ionizing arrangement in the air duct, such that all or most of the flow of air passes through a volume which is enclosed by the shielding electrode, i.e. a volume where ionization of particles will occur.

Furthermore, the ionizing arrangements described in relation to FIGS. 1-5, have at least four arc shaped elements (15; 25) extending from the upstream side of the member, and at least four arc shaped elements (16; 26; 36) extending from the downstream side of the member. It is to be noted that the number of arc shaped elements need not be four but may be for example three arranged such that shielding of electromagnetic emission is achieved. Furthermore, in some embodiments, arc shaped elements may be provided only on the upstream side or in the downstream side depending on the requirements for shielding in different directions.

Furthermore, the ionizing arrangements described in relation to FIGS. 1-5, are disclosed wherein the arc shaped elements have a substantially elongated cross sectional shape in the radial direction from the corona electrode. Embodiments are also encompassed where the arch shaped elements have other shapes, such as having circular cross sectional shape in the radial direction. An aim with the shape of the shielding electrode is to achieve desired amount of shielding whilst at the same time limit the impact on the air flow through the arrangement.

The shielding electrode will generally also be arranged to function as a receiver electrode (or collector electrode). This will reduce the number of components which in turn for example enables reduced impact on the air flow through the arrangement.

Furthermore, the shape of the shielding electrode should preferably be such that an impact on the air flow through the arrangement is limited.

In embodiments of the ionizing arrangement, the shielding electrode is arranged to limit electromagnetic emissions in a direction from the corona electrode in which limiting of electromagnetic emissions is desired. For example, shielding can be provided only upstream from the corona electrode or only downstream from the corona electrode.

By including a shielding part either from the upstream side or from the downstream side only, limitation of electromagnetic field outside the shielding electrode as seen from the corona electrode can be limited on a side for which shielding is desired whereas the other side can be left without any shielding part. Also shielding only in other directions is encompassed, such as upwards or downwards etc.

By including shielding which does not enclose the corona electrode completely but leaves some directions without shielding, the impact on an air flow through the arrangement can be limited, whilst shielding in the directions where it is desired is still accomplished.

It should be noted that the word "comprising" does not necessarily exclude the presence of other elements or steps than those listed and the words "a" or "an" preceding an element do not exclude the presence of a plurality of such elements. It should further be noted that any reference signs do not limit the scope of the claims, that the example embodiments may be implemented at least in part by means of both hardware and software, and that several "means", "units" or "devices" may be represented by the same item of hardware.

In the drawings and specification, there have been disclosed exemplary embodiments. However, many variations and modifications can be made to these embodiments. Accordingly, although specific terms are employed, they are used in a generic and descriptive sense only and not for purposes of limitation, the scope of the embodiments being defined by the following claims.

Itemized List

Item 1. Ionizing arrangement (10; 20; 30) intended to electrically charge particles in an air flow in an air duct (1; 2), said duct comprising a section B extending along an axis A, said arrangement comprising: a shielding electrode (11; 21) intended to be arranged within the air duct, said shielding electrode comprising: a member (13; 23) arranged in a plane substantially transverse to the longitudinal axis A, said member has shape corresponding to the cross sectional shape of the duct; at least four arc shaped elements (15; 25) extending from the upstream side of the; and at least four arc shaped elements (16; 26; 36) extending from the downstream side of the member; and at least one corona electrode (12; 22) arranged in the centre of the member, wherein the arc shaped elements have a substantially elongated cross sectional shape in the radial direction from the corona electrode.

Item 2. Ionizing arrangement (10; 20; 30) according to item 1, wherein the member has an annular shape, circular shape, oval shape or is shaped as a rectangle with semi-circular ends.

Item 3. Ionizing arrangement (10; 30) according to item 2, wherein the corona electrode is one single corona tip (12) arranged in the centre of the circular member.

Item 4. Ionizing arrangement (20) according to item 2, wherein the corona electrode is a wire (22) comprising a number of corona tips arranged along the wire, said wire is extending in the plane of the member with the oval shape or the rectangular shape with semi-circular ends such that the corona tips are arranged across the space within the member.

Item 5. Ionizing arrangement (10; 20) according to anyone of the previous items, wherein the four arc shaped members on the upstream side of the extend from the member to an assembly point (P1; P11) where the at least four arc shaped elements coincide.

Item 6. Ionizing arrangement (10; 20) according to anyone of the previous items, wherein the at least four arc shaped elements on the downstream side of the member extend to a position (P2; P22) where the at least four arc shaped elements coincide.

Item 7. Ionizing arrangement (10; 20; 30) according to anyone of the previous items, wherein the at least four arc shaped elements extending from the member are arranged at substantially the same distance from each other along the upstream and downstream side of the member.

Item 8. Ionizing arrangement (10; 30) according to item 3, wherein the arc shaped elements are curved such that the shielding electrode will have a substantially spherical shape.

Item 9. Ionizing arrangement (20) according to item 4, wherein the arc shaped elements are curved such that the shielding electrode will have a substantially elliptical shape, or a cylindrical shape with half spherical ends.

Item 10. Ionizing arrangement (10; 20; 30) according to item 1, wherein the shielding electrode furthermore comprises intermediate elements (17; 27) arranged between the arc shaped elements on both sides of the member, said intermediate elements are arc shaped with the same radius as the arc shaped elements, said intermediate elements are shorter than the arc shaped elements.

Item 11. Ionizing arrangement (10; 20; 30) according to item 10, wherein said intermediate elements have substantially the same radius as the adjacent arc shaped elements.

Item 12. Ionizing arrangement (10; 20; 30) according to item 10 or 11, wherein the arc shaped intermediate elements have a substantially elongated cross sectional shape in the radial direction from the corona electrode.

Item 13. Ionizing arrangement (10; 20; 30) according to anyone of the previous items, wherein the shielding electrode is made of a conductive material such as a conductive plastic material or a metal.

Item 14. Ionizing arrangement (10; 20; 30) according to anyone of the previous items, wherein the member comprises an upstream part and a downstream part, and the arc shaped elements extending in the upstream direction extend from the upstream part of the member and the four arc shaped elements extending in the downstream direction from the member extend from the downstream part of the member.

Item 15. Ionizing arrangement (10; 20; 30) according to anyone of the previous items, wherein the corona electrode is connected to a positive voltage and the shielding electrode to a negative voltage or ground, or wherein the corona electrode is connected to a negative voltage and the shielding electrode to a positive voltage or ground.

The invention claimed is:

1. An ionizing arrangement for electrically charging particles in an air flow in an air duct, said air duct comprising a section B extending along longitudinal axis A, said arrangement comprising:

a shielding electrode intended to be arranged within the air duct, said shielding electrode having a member for arrangement in a plane substantially transverse to the longitudinal axis A, said member having a shape corresponding to the cross-sectional shape of the duct; and at least one corona electrode arranged in the center of the member, wherein the shielding electrode is further arranged to provide shielding of an electromagnetic field emanating from the corona electrode, and wherein the shielding electrode further comprises:

at least three arc shaped elements extending from the upstream side of the member; and/or at least three arc shaped elements extending from the downstream side of the member.

2. The ionizing arrangement according to claim 1, wherein the shielding electrode is arranged as a Faraday cage.

3. The ionizing arrangement according to claim 1, wherein the shielding electrode comprises:

a net extending from the upstream side of said member; and/or a net extending from the downstream side of the member.

4. The ionizing arrangement according to claim 1, wherein the at least three arc shaped elements have a substantially elongated cross sectional shape in the radial direction from the corona electrode.

5. The ionizing arrangement according to claim 1, wherein the at least three arc shaped elements have a substantially circular cross-sectional shape in the radial direction from the corona electrode.

6. The ionizing arrangement according to claim 1, wherein the member has an annular shape, circular shape, oval shape or is shaped as a rectangle with semi-circular ends.

7. The ionizing arrangement according to claim 1, wherein the member has a circular shape and the corona electrode is one single corona tip arranged in the center of the member.

8. The ionizing arrangement according to claim 7, wherein the at least three arc shaped elements are curved such that the shielding electrode will have a substantially spherical shape.

9. The ionizing arrangement according to claim 1, wherein the member has an oval shape or rectangular shape with semi-circular ends and the corona electrode is a wire comprising a number of corona tips arranged along the wire, and wherein said wire is extends in the plane of the member with the oval shape or the rectangular shape with semi-circular ends such that the corona tips are arranged across the space within the member.

10. The ionizing arrangement according to claim 9, wherein the at least three arc shaped elements are curved such that the shielding electrode will have a substantially elliptical shape, or a cylindrical shape with half spherical ends.

11. The ionizing arrangement according to claim 1, wherein the at least three arc shaped members on the upstream side of the member extend from the member to an assembly point where the at least three arc shaped elements coincide.

12. The ionizing arrangement according to claim 1, wherein the at least three arc shaped elements on the downstream side of the member extend to a position where the at least three arc shaped elements coincide.

13. The ionizing arrangement according to claim 1, wherein the at least three arc shaped elements extending from the member are arranged at substantially the same distance from each other along the upstream and/or downstream side of the member.

14. The ionizing arrangement according to claim 1, wherein the shielding electrode furthermore comprises intermediate elements arranged between the at least three arc shaped elements on one or both sides of the member, said intermediate elements are arc shaped with the same radius as the arc shaped elements, said intermediate elements are shorter than the arc shaped elements.

15. The ionizing arrangement according to claim 14, wherein said intermediate elements have substantially the same radius as the adjacent arc shaped elements.

16. The ionizing arrangement according to claim 14, wherein the arc shaped intermediate elements have a substantially elongated cross-sectional shape in the radial direction from the corona electrode.

17. The ionizing arrangement according to claim 14, wherein the arc shaped intermediate elements have a substantially circular cross-sectional shape in the radial direction from the corona electrode.

18. The ionizing arrangement according to claim 1, wherein the member comprises an upstream part and a downstream part, and the at least three arc shaped elements extending in the upstream direction extend from the upstream part of the member and the at least three arc shaped elements extending in the downstream direction from the member extend from the downstream part of the member.

19. The ionizing arrangement according to claim 1, wherein the corona electrode is connected to a positive voltage and the shielding electrode to a negative voltage or ground, or wherein the corona electrode is connected to a negative voltage and the shielding electrode to a positive voltage or ground.

* * * * *